United States Patent [19]

Biernaux et al.

[11] Patent Number: 4,826,583

[45] Date of Patent: May 2, 1989

[54] APPARATUS FOR PINPOINT LASER-ASSISTED ELECTROPLATING OF METALS ON SOLID SUBSTRATES

[75] Inventors: Alain Biernaux, Mons, Belgium; Lucien Laude, Hautmont, France

[73] Assignee: Lasers Applications Belgium, en abrégé Label S.A., Boussu, Belgium

[21] Appl. No.: 137,330

[22] Filed: Dec. 23, 1987

[51] Int. Cl.[4] ..... C25D 17/00; C25D 5/02

[52] U.S. Cl. ..... 204/224 R; 204/237; 204/224 M

[58] Field of Search ..... 427/53.1; 118/50.1, 118/620; 204/224 M, 224 R, 15, 237; 156/DIG. 80

[56] References Cited

U.S. PATENT DOCUMENTS

| | | | |
|---|---|---|---|
| 4,469,551 | 9/1984 | Laude | 156/DIG. 80 X |
| 4,497,692 | 2/1985 | Gelchinski et al. | 204/224 R X |
| 4,511,595 | 4/1985 | Inoue | 427/43.1 |

FOREIGN PATENT DOCUMENTS

| | | |
|---|---|---|
| 59-129780 | 7/1984 | Japan . |
| 2154017 | 8/1985 | United Kingdom . |

*Primary Examiner*—Donald R. Valentine

*Attorney, Agent, or Firm*—Fleit, Jacobson, Cohn & Price

[57] ABSTRACT

Apparatus for laser-assisted electroplating of metals in closed circuit, comprising a flexible capillary duct into which an electrolyte is injected and at the center of which is located an optical fibre channelling the laser beam. The flexible capillary injecting duct being possibly also centered in a second suction duct allowing the electrolyte to be recovered and recycled. The electrolyte source and the radiation source are combined at the end itself of the capillary duct, and the deposit action can be carried out at any location difficult to access, thanks to the flexibility of the capillary tube-fibre assembly.

6 Claims, 5 Drawing Sheets

APPARATUS FOR PINPOINT LASER-ASSISTED ELECTROPLATING OF METALS ON SOLID SUBSTRATES

FIELD OF THE INVENTION

This invention concerns an automatisable and flexible apparatus allowing a very high definition electroplating of metals to be made. It comprises a capillary duct into which the electrolyte is injected and at the center of which a laser beam-channelling optical fiber is arranged.

DESCRIPTION OF THE PRIOR ART

The traditional electroplating processes are limited in speed (<1000 Å/sec) and in confinement (>$mm^2$). It is presently absolutely necessary to deposite metals quickly (>μm/sec) and on very small areas (a few $10^3$ $\mu m^2$ for example) in order to carry out interconnection of integrated circuits. The speed and confinement can be optionally improved by simultaneously practicing, on the one hand, the laser-assisted electrolysis and, on the other hand, the jet electrolysis.

A laser-assisted electrolysis system with a jet is already known. In this system, an electrolytic liquid is pressed into a tank. An opening in the wall of the latter allows the liquid to escape as a jet. In the axis of this jet, the laser beam passes through the solution and follows the path travelled by the electrolyte.

The assembly consisting of the electrolytic jet and laser beam comes upon a stop surface on which the metal atoms deposit. The stop surface can move into three spatial direction (x, y, z).

The movement is obtained by means of synchronous step-by-step motors for example, the speed of which may vary according to the three axes (x, y, z) and controlled by computer.

Such a system has several drawbacks: (a) the deposit quality (structure homogeneity, adhesion to substrate, profile) depends on the relative jet/laser beam geometry. The deposit is polycrystalline, very adhesive and with a reliable profile when the radiation channeling is well ensured in the flow. However, this is only the case when the latter is laminar. Additionally, it is impossible to control this characteristic with reliability when providing a pinpoint opening into the electrolyte-containing tank. In general, the flow is turbulent and the impact of the beam on the target is disturbed. There follows an instability in the deposit parameters: positionning, linearity in a case of tracing, constitution of the deposited material and lack of reliability in the process. This is especially critical in case of a very high confinement pinpoint deposit or of linear tracings of low cross-section in closed circuit (for example, closing of a track on itself).

(b) Radiation being partly absorbed by the electrolytic bath, the optical index of the latter is modified in the crossed area (which is then heated) with respect to the remaining portion of the liquid.

As a matter of fact, cold liquid and warm liquid have different atomic densities (and consequently different indexes), which is partly compensated by convection movements between warm portions and cold portions of the liquid. These movements cause diffusion of the laser radiation and later reduce the optical energy density at the impact location of the beam on the target.

(c) The system lacks flexibility, and it is as a matter of fact impossible to deposit metals onto locations out of sight of the radiation source.

(d) It is also impossible to simultaneously carry out several distinct deposits with the same laser source.

SUMMARY OF THE INVENTION

The present invention has for the object to remedy these drawbacks. This invention, such as characterized by its claims, solves the problem by creating an apparatus allowing one to carry out electroplating of an excellent quality quickly and precisely in locations difficult to access and in a multiple way. According to the present invention, the apparatus for poinpoint electroplating metals at precise locations on solid substrates by means of a laser radiation with or without an outside electrical source is characterized by using laser radiation which is channelled at the center of an optical fibre which is centered in a flexible capillary duct. Into the latter, the electrolyte containing the dissolved metal to be deposited flows, this metal being thus projected onto the substrate at the outlet of the capillary duct into the area which is irradiated by the laser radiation. A second capillary duct containing the preceding capillary duct and its optical fibre collects by suction the liquid containing the non-deposited metal ions. Due to this process, only the irradiated area is subjected to the action of the electrolytic bath and there is no liquid flow outside the impact point of the jet.

According to a variant of the invention, the laser radiation is divided into several beams which are channelled at the center of several optical fibres, each of which is centered in a flexible capillary duct wherein the electrolytic solution flows, this solution being thus (a) projected on the substrate at the outlet of the capillary duct in the laser irradiated area and (b) recovered by the second capillary duct which surrounds the assembly comprised of the injection capillary duct and the fibre contained therein.

The laser radiation of a YAG or continuous laser, of the Argon ($AR^+$) or Krypton ($Kr^+$) type for example, is pulsated according to the kind of material to be deposited. The output power is between $10^2$ W/$cm^2$ and $10^6$ W/$cm^2$ at the deposit location. The optical fibre channelling the laser radiation is of a known type acting in monomode or multimode. The useful portion of the optical fibre, also called the center or core of the optical fibre, channels the laser radiation. The diameter of the fibre center is selected as a function of the desired confinement (1 μm→500 μm). On the other hand, several distinct fdeposits can be simultaneously made with the same laser source. To this end, the original laser beam is split according to a process described in U.S. Pat. No. 4,469,551, into several beams, each of which is channelled by a fibre up to the working area.

By the term flexible capillary duct, it is meant an inert material duct, for example in Teflon ®, having an outside diameter of for example 1000 μm and an inside diameter of for example 500 μm, into which duct an optical fibre of an outside diameter of for example 125 μm is entered. The selection of a flexible capillary duct depends on the need for preferentially leading the electrolytic solution onto a target area as a jet, this area being possibly difficult to access or being out of direct sight of the radiation source, which proves the apparatus flexibility. The electrolyte circulating into the flexible capillary duct comprises the metal to be deposited in solution. Amongst metals susceptible to be deposited on a solid substrate, one may cite as example, Au, Cu, Ni, Pd, Ag, Cr, Zn and the like. In the case of Au, Cu, etc. for example, the selected electrolyte is for example of the cyanide and sulfate type respectively. Any other commercial type of electrolyte may be selected without departing from the scope of this invention.

The selection of electrolyte depends on the kind of metal film which is to be prepared.

According to a variant of the apparatus, the target or the propelling device comprising the chamber containing the liquid, and the flexible capillary duct containing the optical fibre may be controlled by computer. Automation of the system by computer comprises: (a) control of the electrolyte (ion concentration, acidity and temperature) by continuous sampling, (b) automatically tracing of the deposit by programmed displacement of the target with respect to the jet or of the jet with respect to the target (if the latter is of a too large volume), (c) stability control of the radiation source by photoelectric diode. This automatic allows homogeneous deposits to be provided, of a constant thickness and of a predetermined geometry.

According to another variant of the invention and without changing the elements of the previously described apparatus, it is possible to deposit metals from an electrolytic solution without external electrical current source ("electroless" method). According to the recognized knowledge in this field, the deposits can develop following two distinct chemical modes.

(a) Depositing by immersion

By projection through a capillary duct, of an electrolyte containing more noble metal ions, for example copper sulphate ($CuSO_4$) onto a less noble metal substrate, for example iron (Fe), an exchange reaction for example develops:

$$Cu^{++} + Fe \rightarrow Fe^{++} + Cu$$

causing depositing of the metal initially in the solution, onto the solid substrate.

(b) Catalytic depositing

To the solution containing metal ions, for example nickel ($Ni^{++}$) ions to be electroplated, a reducing substance is added thereto, for example Na hypophosphite ($NaH_2PO_2$) which brings electrons to the system according to reactions (a) and (b). The reducing substance then plays the same role as the external current source in the previously described process with electric voltage $$Ni^{+} + 2H_2PO_2^{-} + 2H_2O \longrightarrow 2HPO^{2-} + 4H^{+} + H_2 + \underset{\downarrow}{\overset{Ni}{}} \quad (a)$$

$$2H_2PO_2^{-} + 2H_2O \xrightarrow[\text{surface}]{\text{catalytic}} 2HPO_3^{-} + 4H^{+} + 2H^{-} \quad (b)$$

$$2H + Ni^{2+} \longrightarrow \underset{\downarrow}{\overset{Ni}{}} + H_2 \quad (c)$$

In the case of a substrate of a non-catalytic kind, as for example plastic materials, ceramics, it is necessary beforehand to activate the surface with substances such as for example $PdCl_2$ and $SnCl_2$. In both above-mentioned modes, the proposed system comprising such a capillary duct, injection capillary duct and optical fibre, performs the same functions as the preceding system (with current source), namely an apparatus wich allows one to quickly and precisely obtain metal deposits of excellent quality, in locations difficult of access and in a multiple way.

A particular use of this system consists no longer in depositing a metal onto a target but in pickling the latter. This can be easily made and without modifying the apparatus in any way, by inverting the arrangement polarities. In this embodiment, corroded or chemically contaminated surfaces may also be plated with metal with the best adhesion conditions.

The advantages which are reached thanks to this invention consist of simultaneous use of the very high flexibility of the electrolytic propulsion system, such as obtained due to the use of a capillary duct, and of the very high handiness of the optical system thanks to channelling of the laser beam into an optical fibre. Inertia of the previous system is thus prevented. As a matter of fact, the housing containing the laser beam and the electrolyte is extremely easy to handle in the present case. Moreover, it allows without any other adding to carry out miniaturized and diversified metal tracks. In locations difficult of access, its geometry allows it to be miniaturized and to be arranged on the same frame with other identical housings. Finally, the electrolyte source and the radiation source being combined at the end itself of the capillary duct, the depositing action may be carried out in any location difficult of access, thanks to the flexibility of the capillary duct/fibre assembly.

The invention is hereinafter described in a more detailed manner with reference to FIGS. 1 to 8.

DESCRIPTION OF THE PREFERRED EMBODIMENTS

Figure 1:
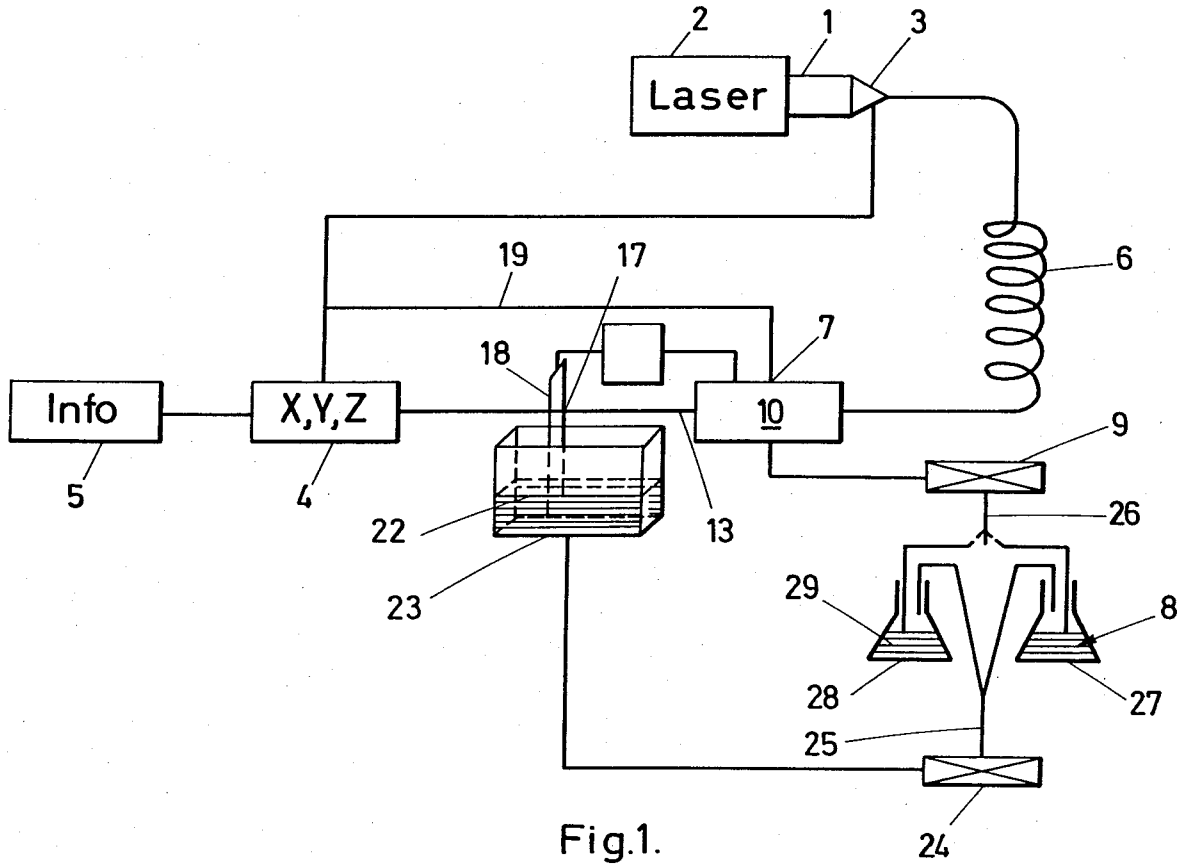
Figure 2:
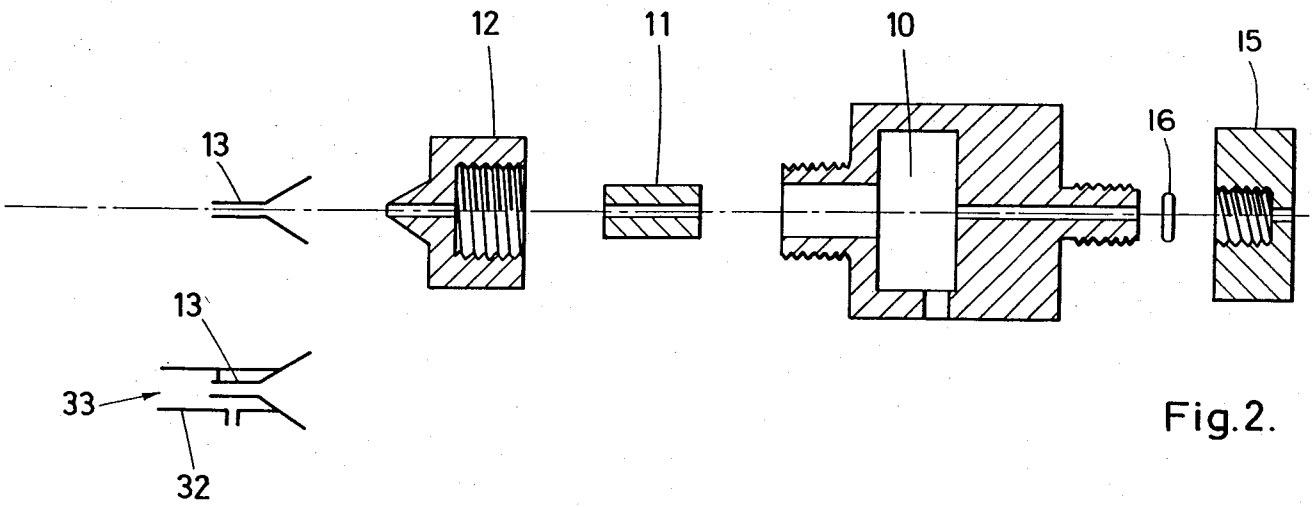
Figure 3:
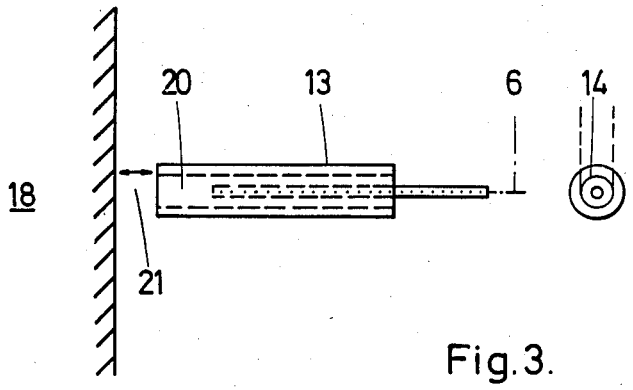
Figure 4:
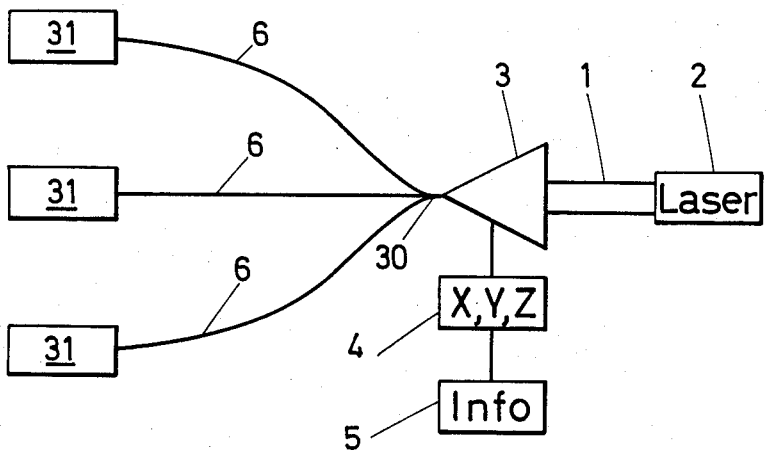
Figure 5:
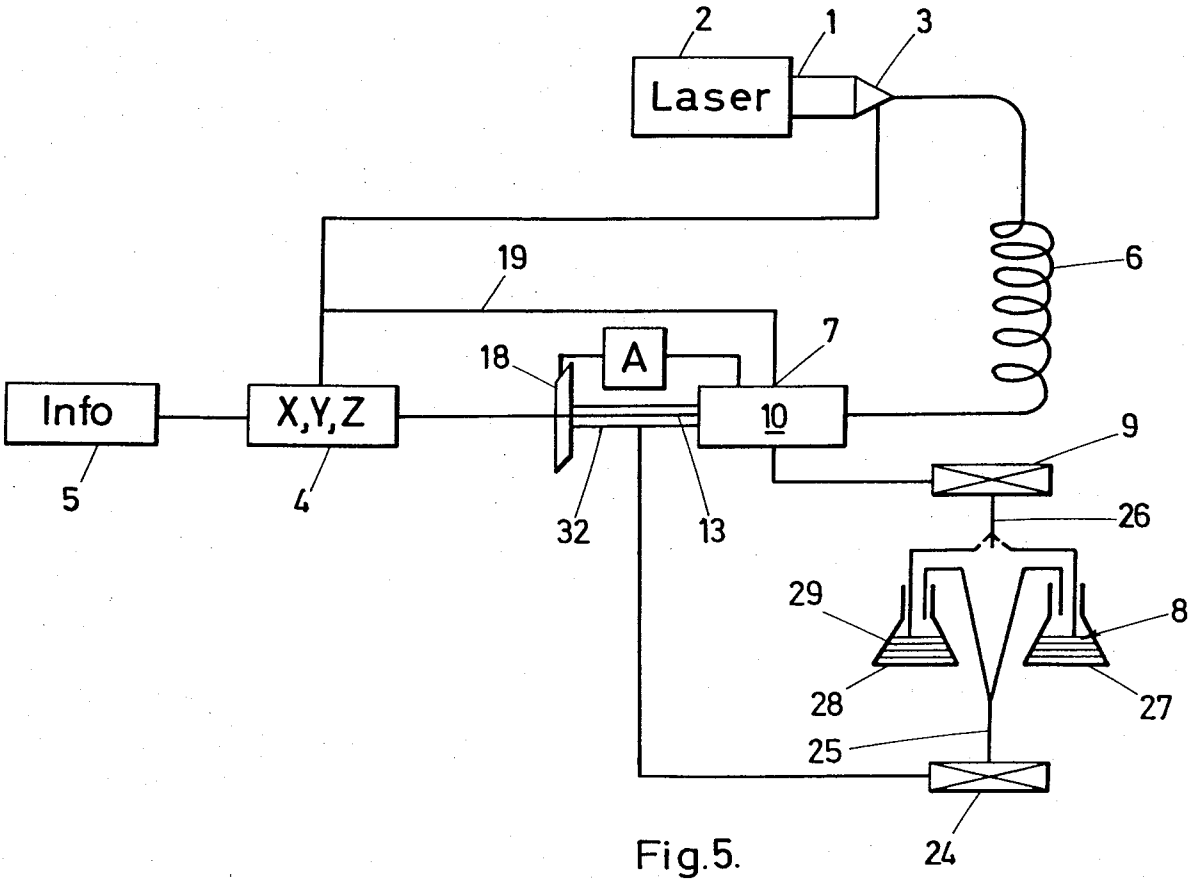
Figure 6:
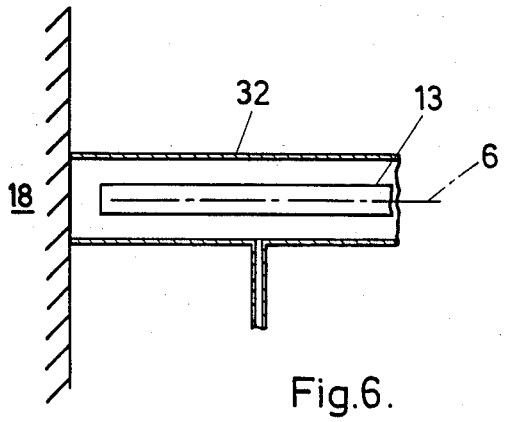
Figure 7:
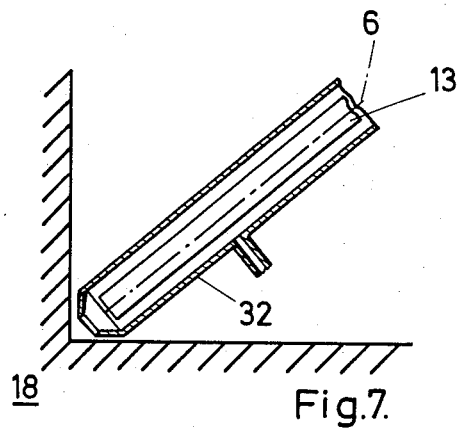
Figure 8:
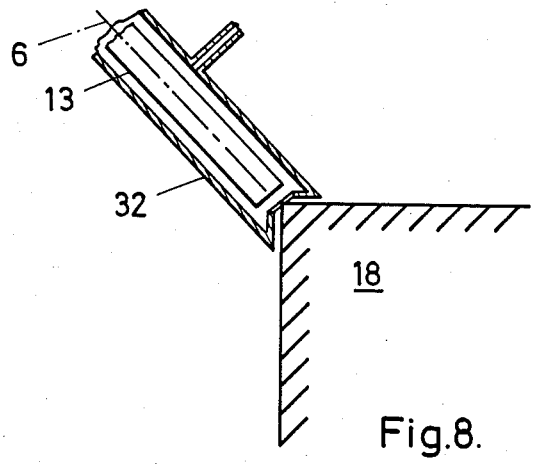

FIGS. 1 and 5 show the same general schematic illustration of the apparatus according to the invention. FIGS. 2, 3 and 6 show the electrolytic cell, the positioning of the fibre in the injection capillary duct and the capillary suction duct respectively. FIG. 4 illustrates how the apparatus can be integrated in a multifibre system.

A light beam (1) deriving from a laser (2) is focused by an optical device (3) guided in the three directions by means of a manipulator (4) controlled by a computer (5). The focused beam is channelled by means of an optical fibre (6) inside the electrolysis cell (7). The electrolytic liquid (8) comprising metals to be deposited is brought into the electrolysis cell (7) by means of a first pump (9). The electrolysis cell (7) is formed of three parts. A first part comprises a constant volume chamber (10) allowing a constant liquid output to be obtained.

On the other hand, a first circular electrode (11) ensures the electrical constact in the liquid and creates ions which are necessary for a good running of the electrolysis.

The second part consists of an electrolytic propulsion cone (12) serving to form the jet. On this cone (12), two capillary duct patterns can be fixed: (a) a simple capillary injection duct (13), (b) a double capillary duct (33) which comprises an injection duct (13) and the fibre (6) thereof, this duct (13) being itself contained in a second capillary suction duct (32). Different sections (14) of the capillary duct (13) are available. This is depending on the desired confinement of the deposit. The third part (15) allows, on the one hand, the optical fibre (6) to be fixed to the electrolysis cell and, on the other hand, it allows to compress a O-ring (16) which preserves the perfect sealing of the system assembly. The jet (17)

comprising the electrolytic liquid (8) and the laser beam (1) is stopped by the surface (18) onto which the metal to be electrolysed is deposited. This surface (18) serves as a second electrode to complete the electric circuit. The electric voltage to both electrodes (11) and (18) is brought by a supply (19).

Formation of metal tracks on the stop surface (18) is ensured by displacement, either of the same surface (18) with respect to the jet (17), or of the electrolysis cell (7) with respect to the surface (18). The displacement x-y is obtained through a manipulator x-y-z (4) controlled by a computer (5). The laminar flow at the outlet of the flexible capillary duct (13) is obtained by positioning (20) of the optical fibre (6) with respect to the end of the flexible capillary duct (13).

The region (21) of the jet (17) in which flow also remains laminar until impact onto the target (18) is controlled by a manipulator (4) along axis z. After impact on the target (18), the electrolyte (8) or (29) is recovered according to two distinct schemes (FIG. 1 and FIG. 5). Both of them depend on the geometry of the target (18) onto which metals are to be deposited. According to a first case (FIG. 1), liquid (22) containing non-deposited metal ions is collected in a tank (23). A second pump (24) provides for the return of the liquid (22) to the start. According to a second situation, FIG. 5 and FIG. 6, liquid (22) containing non-deposited metal ions is recovered by suction through a secondcapillary duct (32) surrounding duct (13) comprising the optical fibre (16). Suction is made from the pump (24). A two-valve (25, 26) system allows the tanks (27) and (28) to be switched. While metal ions are in one (27) of the tanks, the second tank (28) contains a cleaning solution (29). This cleaning solution (29) allows later to deposit other metals without contamination risk by means of the same apparatus. In order to adapt this apparatus to the geometry of the surface to be metal plated or to be pickled, the end of the capillary suction duct (32) can be modified in order to allow a depositing or a pickling to be made, for example at the location of a re-entrant corner or on a solid angle of a member according to schemes 7 and 8.

Thanks to a multifibre network (30) similar to that developped by L. D. Lande in his U.S. Pat. No. 4,469,551, a light beam (1) from only one laser (2) can be channelled into several fibres (30). It is thus possible to provide several identical or different deposits (in quality and/or shape), simultaneously with the same laser source (2) by arranging several electrolysis stations (31) similar to that which has been previously described.

What is claimed is:

1. An apparatus for pinpoint electroplating a metal on solid substrates by means of laser radiation with or without an outside electric source, comprising:
   - an optical fibre arranged to channel at least one beam of laser radiation,
   - a first flexible capillary duct arranged so that the optical fibre is centered therein and in which an electrolytic solution containing metal to be deposited on a solid substrate in solution flows,
   - an electrolysis cell provided with an electrode for electrical polarization of the electrolytic solution, and
   - a device to propel the electrolytic solution in the first capillary duct and, at the outlet of the first capillary duct, onto the solid substrate in an area which is irradiated by the laser radiation so that the metal is deposited on the solid substrate by the laser radiation at precise locations.

2. An apparatus as claimed in claim 1, and further comprising:
   - a second capillary duct surrounding the first capillary duct, and arranged to suck up and recover non-deposited electrolytic solution after it has been projected toward and has impacted on the substrate, and
   - means for recycling the electrolytic solution.

3. An apparatus as claimed in claim 2, and further comprising:
   - means arranged to automatically control displacement of at least one of the substrate, the propelling device of the electrolytic solution, and the first and second capillary ducts and the optical fibre.

4. An apparatus as claimed in claim 2, wherein the end of said second capillary duct is adapted to the geometry of the substrate in an area of the substrate to be selectively covered.

5. An apparatus as claimed in claim 1, and further comprising:
   - a multifibre network arranged to split the laser radiation into several beams which are each channelled at the center of one of several optical fibres, each of said optical fibres being centered in a flexible capillary duct.

6. An apparatus as claimed in claim 1, wherein electrical polarization of the electrolytic solution is opposite that used for depositing to allow pickling of the substrate.

* * * * *